United States Patent [19]

Weinfurth

[11] Patent Number: 4,714,004

[45] Date of Patent: Dec. 22, 1987

[54] APPARATUS FOR HORIZONTALIZATION OF REVOLVABLE WEAPON PLATFORM

[75] Inventor: Udo Weinfurth, Düsseldorf, Fed. Rep. of Germany

[73] Assignee: Rheinmetall GmbH, Düesseldorf, Fed. Rep. of Germany

[21] Appl. No.: 779,204

[22] Filed: Sep. 23, 1985

[30] Foreign Application Priority Data

Oct. 2, 1984 [DE] Fed. Rep. of Germany ..... 3436081

[51] Int. Cl.[4] ..... F41F 23/06

[52] U.S. Cl. ..... 89/37.09; 89/40.02

[58] Field of Search ..... 89/37.02, 37.09, 37.12, 89/37.13, 40.02, 41.09, 41.11; 248/180

[56] References Cited

U.S. PATENT DOCUMENTS 4,489,639 12/1984 Winkler et al. ..... 89/40.02

FOREIGN PATENT DOCUMENTS 2037819 2/1972 Fed. Rep. of Germany ..... 89/37.09
3143881 10/1982 Fed. Rep. of Germany .
3307069 9/1984 Fed. Rep. of Germany ..... 89/37.09
218 1/1982 World Int. Prop. O. .
495032 9/1970 Switzerland .
550460 4/1974 Switzerland .
13318 of 1915 United Kingdom ..... 89/37.09
513338 10/1939 United Kingdom ..... 89/37.12

OTHER PUBLICATIONS

Hoesch Rothe Erde-Schmiedag A.G., Rothe Erde Drahtwälzlager, pp. 3 & 11.

*Primary Examiner*—Stephen C. Bentley

[57] ABSTRACT

An installation to horizontalize a weapon platform, consisting of two hollow bodies which telescope into one another, is mounted on a vehicle body or vehicle roof which serve as a stationary base. Thereby, a cylindrical inner surface of the first external hollow body, and a cylindrical outer surface of the second internal hollow body, enclosed by the surface, are parallel to each other, and form an inclined plane which is inclined at an angle, relative to a bearing surface of the outer surface of the first hollow body, which is adjusted in the vehicle body or the vehicle roof. A bearing, which is mounted in the surface, is fixed in an annular member which preferably can be detached from the vehicle body or vehicle roof. The installation is suitable for high angle fire arms, and enables both manual and automatic horizontalization, and, in addition, permits an all-directional load bearing capability.

3 Claims, 3 Drawing Figures

APPARATUS FOR HORIZONTALIZATION OF REVOLVABLE WEAPON PLATFORM

The invention concerns an installation for horizontalization of a revolvable weapon platform.

CROSS REFERENCE TO RELATED APPLICATION

This application is related to the commonly owned copending application Ser. No. 578,057 filed Feb. 8, 1984 which has issued as U.S. Pat. No. 4,662,265.

Such an installation is suitable for manual an automatic horizontalization of high angle trajectory arm systems, such as howitzers, anti-air-craft guns, mortars, etc. The installation can transmit heavy loads onto whatever basis, e.g. onto a vehicle standing at a tilt in an inclined position during high barrel elevation.

It is the object of the invention, to provide an installation which is not only suitable for high angle fire arms, and which enables both manual and automatic horizontalization, but which, in addition, permits an all-directional load bearing capability.

The said object is achieved by the present invention, advantageous practical embodiments becoming clear from the following detailed description.

In view of the fact that the inclined surfaces, which are used for the horizontalization process, are formed by interengaging ring shaped hollow bodies and the weapon platform is arranged in the inner region of the inner hollow body, it is advantageously possible, to adjust the position of the axes of rotation of the horizontalization system and of the weapon movement in such a manner, that they intersect all at a common point with the axes of rotation and the thereto vertical active surfaces of bearings of the hollow bodies as well with the plane of the weapon platform and the trunnion axis of the barreled weapon.

As a result of this adjustment, torques on bearings, caused by the weapon recoil, are prevented. Moreover, the installation is able to transmit equally strong upward, backward, and downward forces at space-saving two-sided provision of three-ply roller bearings at the inside and outside of the hollow bodies necessary for the horizontalization, and at the weapon platform. Therefore the installation also can transmit heavy firing loads at a low elevation of below 45°, and during the travel of the vehicle it can absorb high upward directed accelleration forces, resulting from the mass-inertia of the barreled weapon.

In a further advantageous manner, a particularly simple horizontalization is made possible by an integration of a return transmission gear in a horizontalization gear, as a result of which the position of the weapon platform in peripheral direction by means of the return transmission gear remains unchanged during the revolving motions of the hollow bodies. Furthermore, the horizontalization gear is more easily operated, and permits a horizontalization of the weapon platform either manually by operating a drive lever, or automatically by a servo-motor.

The invention will be described in detail, and will be illustrated by the accompanying drawings, in which.

Figure 1:
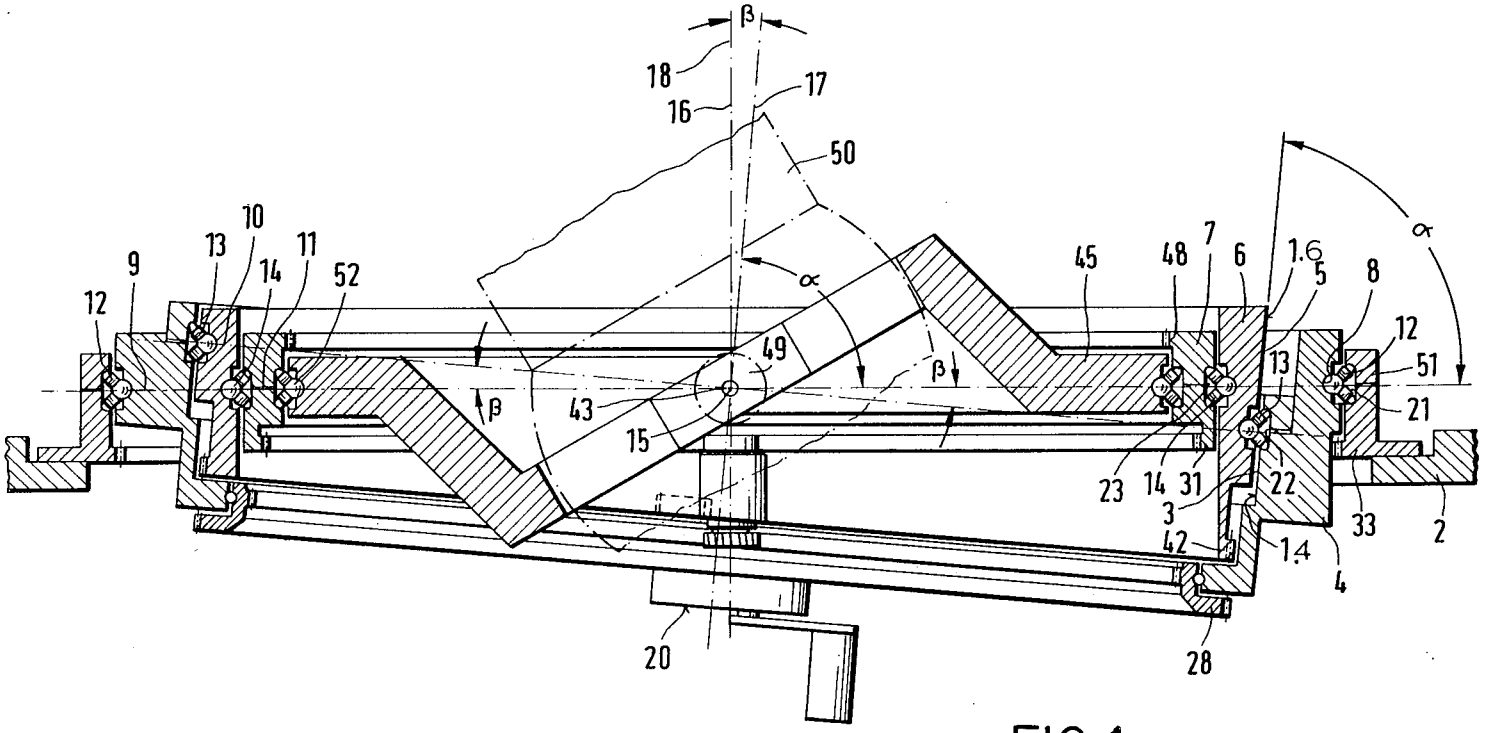
FIG. 1 is a cross-sectional view of an installation with a horizontalized weapon platform, positioned on the roof of a horizontally placed vehicle.

According to FIG. 1, an installation to horizontalize a weapon platform 7, consisting of two hollow bodies 4,6 which telescope into one another, is mounted on a vehicle body or vehicle roof 2 which serve as a stationary base. Thereby, a cylindrical inner surface 3 of the first external hollow body 4, and a cylindrical outer surface 5 of the second internal hollow body 6, enclosed by the surface 3, are parallel to each other, and the edges of which form an inclined planes 1.4 and 1.6 which is inclined at an angle $\alpha$, relative to a bearing surface 8 of the outer surface of the first hollow body 4, which is adjusted in the vehicle body or the vehicle roof 2. A bearing 12 which is mounted in the surface 8, is fixed in an annular member 51 which preferably can be detached from the vehicle body or vehicle roof 2.

Starting from the intersection point 15 of the rotation axis 16, and the operative plane 9 of the bearing 12, extending normal relative to the axis 16 is an axis of rotation 17 of a bearing 13 which forms an angle $\alpha$ with the operative plane 9. The said bearing 13 is positioned intermediate the inclined plane 1 of the first and second hollow bodies 4,6. The maximal inclination of the operating plane 10 of this bearing 13 relative to the operative plane 9 of the bearing 12 is defined by an angle $\beta$, respectively the angle difference being 90° minus $\alpha$, or in other words—the difference of 90° minus $\alpha$, the angle $\beta$ being preferably 5°, maximally 10°.

Also the operative plane 11 of a bearing 14 which is fixed to the inside of the second internal hollow body 6 and the outer surface of the weapon platform 7, inclined at the same angle $\beta$ to the operative plane 10 of the bearing 13, intersects the point 15.

The weapon platform 7 is formed as a ring-shaped hollow disc, adjusted in parallelism to the operative plane 11, so that the part of the bearing chamber 23 (FIG. 2) of the bearing 14 which is positioned in the second hollow body 6, forms horizontalizable planes for the reception of the weapon platform 7.

Since the operative plane 11 of the bearing 14 is situated in the operative plane 9 of the vehicle-fixed-bearing 12, the axis 18 of the bearing assumes a registering position relative to the rotation axis 16. In this position, the weapon platform 7 and the vehicle body or the vehicle roof 2 are all in a horizontal position.

Figure 2:
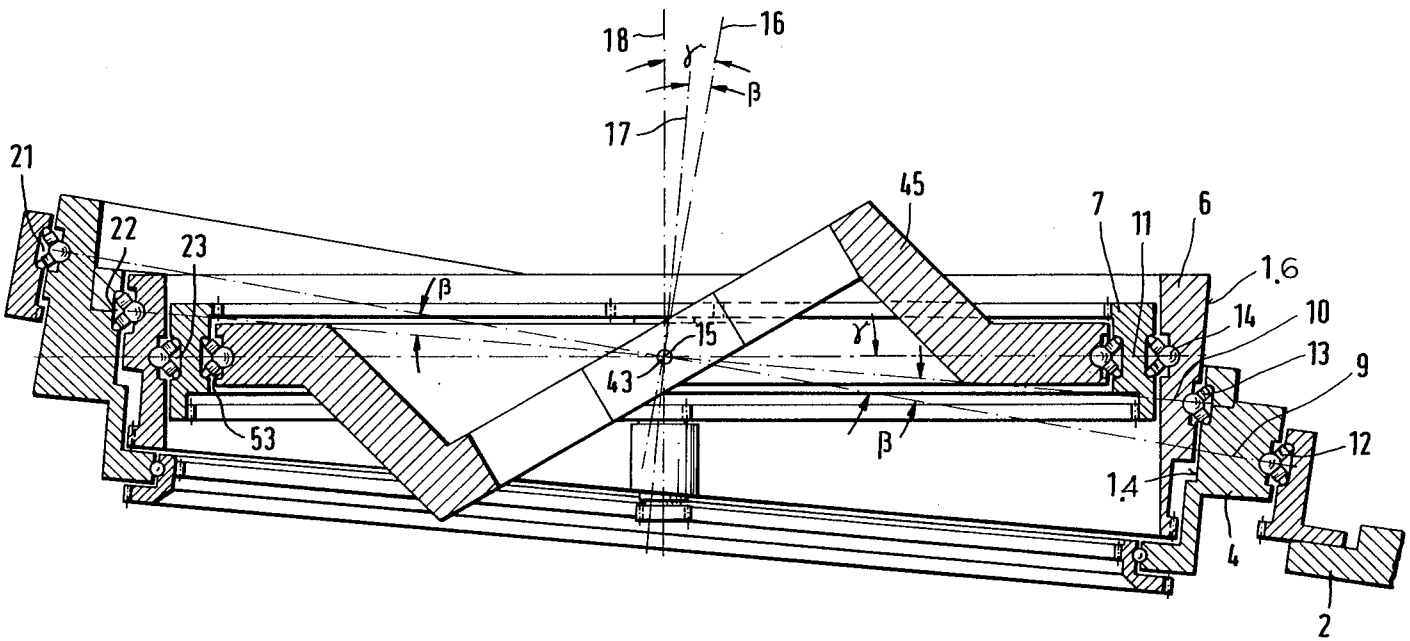
FIG. 2 is a cross-sectional view of an installation with a horizontalized weapon platform, positioned on the roof of a vehicle in inclined position.

Due to various rotatory motions of the hollow bodies 4,6 and the weapon platform 7, which will be elaborately explained in the description of the horizontalization drive (FIG. 3), the weapon platform of a vehicle roof 2 which stands in an inclined position as shown in FIG. 2, can be swung into a horizontal position about the axis of rotation 43. With a vehicle roof 2 in such an inclined position, only the operative plane 11 of the bearing 14 of the weapon platform 7 assumes a horizontal position, whereby the operative plane 10 of the bearing 13 which is inclined at an angle $\beta$ relative to the operative planes 9 and 11, bisects the total of the inclination angle $\gamma$ of the vehicle roof 2 which is inclined facing the weapon platform 7. Accordingly the axis of rotation 17 bisects the angle $\gamma$ which is formed by the axes of rotation 16 and 18.

In the operative plane 11 another bearing 52 is provided inside the weapon platform 7 for the lateral alignment of the recoil absorbing disc 45. The center section of the said bearing is formed in such a manner, that the axis of trunnion 49 which is positioned at the crossing point 15, warrants an optimal swing orbit of the barreled weapon 50 between low elevations of less than 45° and maximum barrel elevation of 85°.

Due to the fact, that the operating planes 9,10,11 of the bearings 12,13,14, which are positioned between the first hollow bodies 4 and the vehicle body or vehicle roof 2 respectively and between the inclined plane 1 of the first and second hollow bodies 4,6, as well as between the second hollow body 6 and the weapon platform 7, intersect at a point 15 with the axes of rotation 16,17,18 and the axis 43 of the weapon platform 7, as well as with the trunnion axis 49 of the barreled weapon 50, a power transmission free of a moment of inertia of the weapon recoil onto the bearings 12,13,14, can be achieved after each horizontalization of the weapon platform 7 about the axis 43 (FIG. 2) over the trunnion axis 49.

For power transmission, the bearings means 12,13,14,52, comprise preferably three-ply roller bearings, which are adjusted in modular ringshaped chambers 21,22,23,53 (FIG. 2). These bearing chambers consist of grooves and milled recesses which are symetrically positioned relative to the operating planes 9,10,11. These grooves and recesses are made at the bearing 12 in the operative plane 9—outside the hollow body 4 and inside on the vehicle body or vehicle roof 2 respectively. At the bearing 13 in the operating plane 10 inside, on the inner surface 3 of the hollow body 4 and on the outer surface 5 of the hollow body 6; at the bearing 14 in the operative plane 11 inside on the hollow body 6 and inside on the weapon platform 7; and at the bearing 52 also in the operative plane 11 inside on the weapon platform 7 and outside on the surface of the weapon recoil absorbing disc 45.

Figure 3:
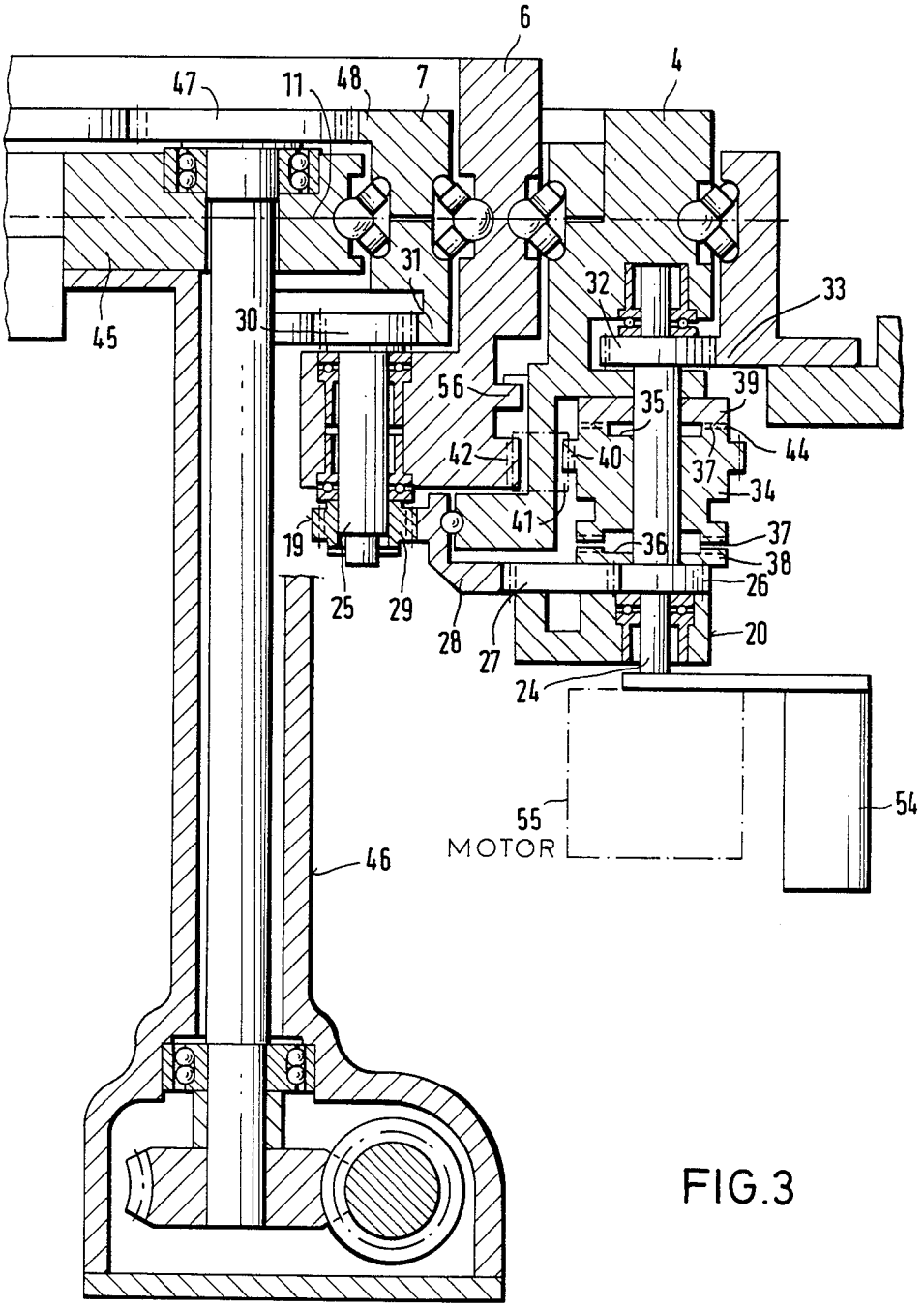
FIG. 3 is a cross-sectional view of a horizontalization gear and return transmission gear connected to the installation, and a lateral laying gear connected to the shock absorbing disc of the barreled weapon.

In a track system which is positioned in such a way, the ring member 51, the telescoping hollow bodies 4,6, as well as the weapon platform 7, are provided for horizontalization with at least one toothed wheel rim 28,31,33,42,48, (FIG. 3).

According to FIG. 3, a horizontalization gear 20 which is coupled to a reversing gear 19, is connected in such a close manner to the toothed rims, that during the rotary motions of the hollow bodies 4,6 which are necessary for the horizontalization, the direction of the weapon platform 7 in peripheral direction remains unchanged.

At that time the drive shafts 24 of the horizontalization gear 20 in the hollow body 4 and the shaft 25 of the reversing gear 19 are revolvably seated within the hollow body 6. A toothed wheel 26 of the horizontalization gear continuously meshes via a toothed wheel 27 and the rim 28 with a toothed wheel 29. Simultaneously a toothed wheel 30, which is fixedly connected with the shaft 25 of the gear 19, permanently meshes with the rim 31 fixed at the weapon platform 7, and an additional toothed wheel 32, which is positioned on the drive shaft 24 of the horizontalization gear 20, permanently meshes with the gear rim 33 which is secured to the vehicle body or the vehicle roof 2, respectively.

On the drive shaft 24 a revolvable coupling 34 is axially movable, which on both frontal sides 35,36 has fitting means 37 for alternate linkage to a coupling disc 38 that is connected to the hollow body 4.

The coupling 34 contains in its peripheral area a toothed wheel 40, which continuously meshes, via a toothed wheel 41, with an externally toothed rim 42 that is positioned on the hollow body 6.

To horizontalize the axis 43 of the weapon platform 7, the coupling 34 is positioned at an adapter 44, which is connected with the coupling disc 39, so that a joint turn position of the hollow bodies 4,6 can be achieved.

To horizontalize the weapon platform around the axis 43, the coupling 34 is positioned such, that it is connected to the coupling disc 38, so that, at a relation of revolution and transmission ratio of the hollow body 4 to the hollow body 6 of 1:2, simultaneous and similar rotative motions of the hollow bodies 4,6 are attainable in reversed directions. Thereby, the revolution and transmission ratio is determined firstly by the number of teeth of the rim 33 and of the toothed wheel 32, and secondly by the number of teeth of the toothed wheel 40 and its external gear 42.

The revolution transmission ratio of body 4 to platform 7 is equal, however at reverse revolution direction, so that in order to achieve the unchanged peripheral direction of the weapon platform 7, when the hollow structure 4 moves counter clockwise, the reversing device 19 simultaneously and clockwise moves the weapon platform 7, in relation to the hollow body 4.

The horizontalization gear 20 may be operated either manually by a hand lever 54, or automatically by means of a motor 55. In both cases the following operation steps are required to horizontalize the weapon platform 7:

For the establishment of an initial position, the coupling 34 is to be moved downward, and the drive shaft 24 should be rotated until the motion is halted by an abutment 56 which is secured to the hollow body 6. In this position of the hollow bodies 4,6, the operative planes 9,11 are positioned at the same level. During this motion, the whole horizontalization installation has turned in relation to the vehicle roof 2, this based on the toothed wheel 32 which meshes with the rim 33. Thereby the weapon platform 7 is turned back simultaneously via the toothed wheel 27, the rim 28, and the reversing gear 19, so that its peripheral direction remains unchanged.

For determination of the axis 43 of the weapon platform 7, the coupling 34 has to be moved upwardly. The drive shaft 24 must thereupon be rotated, until a gas bubble of a positioning device, preferably a case level which could be fixed to the weapon platform 7 or to the shock absorbing disc 45, has reached a maximal stop inside the marking. During this rotative motion, the hollow bodies 4,6 have jointly turned in the same direction, while the weapon platform 7 has maintained its peripheral direction.

In order to horizontalize the weapon platform 7 around the axis 43, the coupling 34 has to be moved downwards again, until it leaves the coupling disc 39 and engages in the coupling disc 38. The hollow bodies 4,6 are moved simultaneously and similarly, however in reversed direction by rotating the drive shaft 24, until the gas bubble in the case level has taken its central position. Thereby the unchanged peripheral direction of the weapon platform 7, is swung around the already horizontalized swivel axle 43, and is also being horizontalized.

The shock absorbing disc 45, and thus the barreled weapon 50 (FIG. 1), are now lateral directive in horizontal position of the weapon platform 7, by means of a lateral directional drive 46 which is linked to the shock absorbing drive 45, which is located over a toothed wheel 47 and over the rim 48, which is connected to the weapon platform 7.

Because of the fact that the reversal gear 19 is adjusted at a right angle in relation to the operative plane 11 of the bearing 14, and the horizontalization gear 20 is adjusted perpendicularly to the operative plane 10 of the bearing 13, the lower toothed wheel 29 of the reversed gear 19 and the rim 28, as well as the toothed wheel 32 of the gear 20 and the vehicle's secured toothed rim 33, define an oblique toothing inclined in conformity to the angle $\beta$.

I claim:

1. An apparatus to horizontalize a revolvable weapon platform, which, in order to compensate for lateral tilt and inclined position, relative to a stationary basis, is mounted on the gun-carriage of a vehicle, as an intermediate carrier for a weapon turret, which comprises: two ring shaped hollow bodies that are connected for common and mutually opposed rotatory movement, the facing lateral surfaces of the said hollow bodies running parallel and forming inclined planes facing a bearing surface of the first hollow body which is fixed preferably in the vehicle body, one side of the second hollow body comprising a horizontalizable receiving surface for the weapon platform, whereby a swing axis of the weapon platform assumes a horizontal position when both hollow bodies assume a mutually turned position, and the weapon platform simultaneously assumes a horizontally but oppositely directed turned position to the hollow bodies, around the swing axis, characterized thereby that the weapon platform is arranged within the radial inner region of the hollow body enclosed in the first hollow body; and the first hollow body is arranged within the radial inner region of the vehicle body; and a two-ply steep angle roller bearing is arranged between the weapon platform and the second hollow body, between the first hollow body and the vehicle roof, and between the first and second hollow bodies; whereby the axes of rotation, respective to each two-ply steep angle roller bearing, as well as the operative surfaces of the bearings vertical to the axes of rotation, intersect at a point with a turret axis of a barrel weapon arranged on the weapon platform; and that furthermore the hollow bodies are form locked connected with the platform via a reversing gear coupled to a horizontalizing gear, so that the during rotatory movements of the hollow bodies required for horizontalization, the direction of the platform remains unchanged in its peripheral direction by means of the reversing gear.

2. An apparatus as claimed in claim 1, wherein:

a drive shaft of the horizontalization gear is fixed in a revolvable manner in the first hollow body;

a shaft of a reversal transmission is fixed in a revolvable manner inside the second hollow body;

a toothed wheel is positioned on the drive shaft of the horizontalization gear continuously meshes with a rim which is fixed to the vehicle body;

a revolvable coupling is mounted in an axially movable manner on the drive shaft, and contains on both frontal sides contact means, which are linked alternatively to a first coupling disc, said first coupling disc is connected to the drive shaft, or to a second coupling disc which is connected to the hollow body;

the revolvable coupling contains in its peripheral area a second toothed wheel, which over an intermediate wheel, meshes with a toothed rim that is positioned on the second hollow body wherein;

to horizontalize the axis of the weapon platform, the revolvable coupling is set in a position that is connected to the coupling disc, so that the joint revolving position of the hollow bodies can be obtained;

to horizontalize the weapon platform about the axis of the weapon, the revolvable coupling is positioned in a location that is connected to the first coupling disc, so that at a transmission ratio of the first hollow body to the second hollow body is 1:2, the simultaneous and identical rotatory motions of the hollow bodies can be effected in opposite rotational directions; and wherein the transmission ratio of the first hollow body to the weapon platform is equal to, but opposed to the rotational direction, so that in order to achieve the unchanged peripheral direction of the weapon platform, while the hollow body moves counter clockwise, the reversal transmission simultaneously moves the weapon platform clockwise in relation to the first hollow body.

3. Installation as claimed in claim 2, wherein the weapon platform is ring shaped, and within it is a weapon receiving disc which is rotational on the operative surface of the bearing, and to which is fixedly attached a lateral directional drive, which, in order to achieve the rotative motion of the disc, meshes via a toothed wheel with a rim which is positioned inside the weapon platform.

* * * * *